United States Patent [19]

Patron et al.

[11] 4,001,485

[45] Jan. 4, 1977

[54] PROCESS FOR SPINNING ACRYLIC POLYMERS

[75] Inventors: Luigi Patron, Venice; Pier Luigi Mazzuco, Favar Veneto (Venice); Favato Veneto, Mestre; Enzo Trevisan, Mestre (Venice); Ennio Niero, Mirano (Venice), all of Italy

[73] Assignee: Montefibre S.p.A., Milan, Italy

[22] Filed: Nov. 26, 1974

[21] Appl. No.: 527,259

[30] Foreign Application Priority Data

Nov. 29, 1973 Italy ..... 31931/73

[52] U.S. Cl. ..... 526/341; 264/182; 526/342

[51] Int. Cl.[2] ..... D01F 6/18; C08F 220/42

[58] Field of Search ..... 264/182, 38; 526/341, 526/342

[56] References Cited

UNITED STATES PATENTS

| | | | |
|---|---|---|---|
| 2,902,335 | 9/1959 | Salcurai et al. | 264/38 |
| 3,318,983 | 5/1967 | Hovie et al. | 264/182 |
| 3,440,148 | 4/1969 | Melauci et al. | 264/38 |

FOREIGN PATENTS OR APPLICATIONS

| | | | |
|---|---|---|---|
| 37-14425 | 9/1962 | Japan | 264/182 |
| 43-552 | 1/1968 | Japan | 264/182 |

*Primary Examiner*—Jay H. Woo
*Attorney, Agent, or Firm*—Stevens, Davis, Miller & Mosher

[57] ABSTRACT

An improved process for the wet-spinning of acrylic polymers is disclosed, wherein a spinning solution of an acrylic polymer in an organic solvent, such as dimethylacetamide or dimethylformamide, is extruded through a spinneret into a coagulating bath consisting essentially of water and an organic solvent in a ratio between 30:70 and 60:40 by weight, and wherein the filaments thus obtained are washed, stretched and heat treated, and wherein the coagulating bath contains from 0.03% to 3% by weight of acid corresponding to said organic solvent and has a pH value greater than 5, and preferably between 6.5 and 8. The spinning solvent is preferably dimethylacetamide containing free acetic acid to an extent of less than 0.1% by weight, the acetic acid if necessary being added to the coagulating bath to bring its concentration up to values between 0.03% and 3% by weight. The pH value greater than 5 is obtained by the addition to the coagulating bath of ammonium hydroxide, an alkali metal hydroxide, or dimethylamine.

9 Claims, No Drawings

PROCESS FOR SPINNING ACRYLIC POLYMERS

The present invention relates to an improved process for spinning acrylic polymers. More particularly, this invention relates to an improved process for the wet spinning of a solution of acrylic polymers in an organic solvent such as, for instance, dimethylacetamide and dimethylformamide.

As is well known, the wet spinning of acrylic polymers consists in extruding through a spinneret, and into a suitable coagulating bath, a solution of the polymer in one of its organic solvents, for instance dimethylacetamide, and in then stretching and heat treating the filaments or threads thus obtained. As the coagulating bath one uses a solution consisting of water and dimethylacetamide in a suitable ratio, in general a ratio between 30:70 and 60:40 by weight, respectively.

Such a coagulating bath in general has a pH value below 5, due to the free acetic acid present in the dimethylacetamide. This acetic acid is generated by hydrolysis of the solvent dimethylacetamide during the recovery phase, which is carried out by distillation.

The filaments coming out of the coagulating bath have, however, the drawback of not being very compact inasmuch as they show internal voids and superficial flaws. This phenomenon is intensified further by the presence of titanium dioxide added, as it is known, to the spinning solution as a dulling agent for the fibers. Of course such drawbacks have an unfavorable effect on the resulting fibers because of less desirable physical properties such as brightness, elongation-at-break, resistance-to-abrasion, etc., and as well as a reduction in their processability on textile machines.

In order to reduce or eliminate these flaws, it is already known to increase the viscosity of the spinning solution at the moment of extrusion. This may be brought about either by increasing the concentration of solids in the spinning solution, or by increasing the intrinsic viscosity of the polymer, or by reducing the temperature of the coagulating bath or of the spinning solution, or by using the solvent, for instance dimethylacetamide, with a high content in free acid (acetic acid).

Increasing the viscosity of the spinning solution at the moment of extrusion, apart from the way in which it is achieved, comprises in a substantial way rheological performance of the spinning solution during extrusion, with regard to the stretchability of the filaments and therefore the takeup speed at the outlet of the coagulation bath (see D. R. Paul — "A Study of Spinnability in the Wet-Spinning of Acrylic Fibers" — J. Applied Polymer Science, Vol. 12, pp. 2273–2298, 1968).

Thus, an object of this invention is that of providing an improved wet-spinning process for acrylic polymers which will allow one to obtain more compact filaments or threads, without prejudicing the rheological behavior of the spinning solution at the moment of extrusion.

It has now suprisingly been found in accordance with this invention, that this subject is achieved by carrying out the extrusion of the spinning solution of acrylic polymer in one of its organic solvents, into a coagulating bath consisting of water and solvent, in which bath concentration of the acid, corresponding to the solvent used, is between 0.03% and 3% by weight, and where the pH value is greater than 5, and preferably between 6.5 and 8.

The required pH value of the coagulating bath is obtained by adding thereto a suitable alkaline compound. This compound may be any alkalizing agent, even though in practice those are preferred which, with the acid present in the bath, will form a salt which is either water-soluble or easily removable by washing with water. Among these alkaline compounds the best results are obtained with ammonium hydroxide or the hydroxide of an alkali metal such as sodium or potassium, or with dimethylamine. Dimethylamine is particularly advantageous inasmuch as the dimethylammonium acetate that is formed may be reconverted to dimethylacetamide in the stage for recovery of the solvent by distillation.

In the following Table I, there is evidenced the influence of the pH value of the coagulating bath on the compactness of the fiber and the influence of the polymer concentration of the spinning solution on the rheological behavior of said solution. The compactness of the fiber is determined by the number of voids present inside the single filaments at the outlet of the coagulation bath. The rheology of the spinning solution is determined by the maximum speed with which the draw-off rollers are capable of drawing the filaments from the coagulating bath without breakage.

In the reported tests, the spinning solvent is dimethylacetamide with a free acetic acid content of 0.3% by weight and the polymer is a copolymer of acrylonitrile consisting of 93% by weight of acrylonitrile and 7% of vinyl acetate and having a content in end acid groups, derived from the catalytic system ($S0_2$-potassium persulphate) equal to 35 micro-equivalents/g, and a specific viscosity of 0.15 (measured in an 0.1% solution in dimethylformamide at 25° C).

0.5% by weight, with respect to the polymer, of titanium dioxide is added to the spinning solution as a dulling agent.

The coagulating bath consists of water and dimethylacetamide in a 50/50 ratio by weight, with a content in acetic acid of 0.15% coming from the spinning solution. The coagulating bath is maintained at a temperature of 55° C.

The filaments are stretched with a stretching ratio of 6 in order to obtain filaments each showing a count of 2 den.

TABLE I

| % by weight of polymer in the spinning solution | Coagulating Bath | | Number of voids per millimeters of fiber | Maximum speed of draw-off rollers in meters/minute |
|---|---|---|---|---|
| | pH | added compound | | |
| 23 | 4.2 | — | 450 | 25.0 |
| 24.5 | 4.2 | — | 200 | 20.0 |
| 23 | 7.5 | $NH_4OH$ | 140 | 26.0 |

As can be seen from the results reported in Table I, an increase of polymer concentration in the spinning solution brings about a rise in the compactedness of the filaments but at the same time prejudices the rheological properties of the spinning solution. On the other hand, an increase in the pH value in the coagulating bath allows one to obtain much more compact filaments while leaving the rheological properties of the spinning solution practically unvaried or even improved.

The tests reported in Table I were carried out with a spinnert of 500 holes having a diameter of 52$\mu$,and using different flow rates of the spinning solution feeding pump in relation to the spinning solution concentration, so as to maintain constant the flow rate of the polymer in g/min. per hole. More particularly, for the solutions having a concentrationn of 23% by weight of polymer, the flow rate of the pump amounted to 49.47 cc/min., while the solution having a concentration of 24.5%, the flow rate amounted to 45.2 cm/min.

The influence of the pH value and the acid content of the coagulating bath on the compactedness of the fiber and on the rheological properties of the spinning solution is clearly evidenced by the tests shown in the following Table II, wherein the starting polymer, the solvent, the composition, and the temperature of the coagulating bath are the same as those used in the tests of Table I. The polymer concentration of the spinning solution is 23% by weight.

TABLE II

| % by weight of free acetic acid in the spinning solution | Coagulating Bath | | | Number of voids per millimeters of fiber | Maximum draw-off rate of rollers in meters/minutes |
|---|---|---|---|---|---|
| | % of acetic acid | pH value | added compound | | |
| 0.03 | 0.015 | 5 | — | >700 | 29.0 |
| 0.03 | 0.015 | 6.5 | $NH_4OH$ | >700 | 29.0 |
| 0.03 | 0.015 | 7.5 | $NH_4OH$ | >700 | 29.0 |
| 0.15 | 0.075 | 4.2 | — | 550 | 28.0 |
| 0.15 | 0.075 | 6.5 | $NH_4OH$ | 320 | 28.0 |
| 0.15 | 0.075 | 7.5 | $NH_4OH$ | 220 | 28.0 |
| 0.3 | 0.15 | 4.2 | — | 450 | 25.0 |
| 0.3 | 0.15 | 6.5 | $NH_4OH$ | 220 | 26.0 |
| 0.3 | 0.15 | 7.5 | $NH_4OH$ | 140 | 26.0 |
| 0.5 | 0.25 | 4.2 | — | 420 | 23.0 |
| 0.5 | 0.25 | 6.5 | $NH_4OH$ | 90 | 23.0 |
| 0.5 | 0.25 | 7.5 | $NH_4OH$ | 60 | 23.0 |

The results recorded in Table II clearly evidence the influence on the compactness of the fiber exerted by the pH and by the quantity of acetic acid in the coagulating bath. It will be noticed, however, that an increase of free acid present in the spinning solvent will have a negative influence on the rheological properties and thus on the spinnability of the solution or on the maximum speed of the draw-off rollers.

Furthermore, it has surprisingly been found that when the concentration of free acid in the dimethylacetamide is kept below 0.1% by weight and the acetic acid is directly fed into the coagulating bath so as to bring the concentration thereof to values between 0.03 and 3% by weight, best results are obtained as far as compactness of the filaments after coagulationn is concerned as well as with the regard to the spinnability of the spinning solution.

In confirmation of the above assertions, the following Table III gives the results of a series of tests:

TABLE III

| % by weight of free acetic acid in the spinning solution | Coagulating Bath | | | | Number of voids per millimeters of fiber | Maximum speed of draw-off rollers in meters/minutes |
|---|---|---|---|---|---|---|
| | % of acetic acid | addition of acetic acid | pH value | added compound | | |
| 0.5 | 0.25 | none | 7.5 | $NH_4OH$ | 60 | 23 |
| 0.15 | 0.075 | none | 7.5 | $NH_4OH$ | 220 | 28 |
| 0.03 | 0.015 | none | 5 | — | >700 | 29 |
| 0.03 | 0.075 | yes | 7.5 | $NH_4OH$ | 210 | 29.5 |
| 0.03 | 0.15 | yes | 7.5 | $NH_4OH$ | 145 | 29.5 |
| 0.03 | 0.25 | yes | 7.5 | $NH_4OH$ | 50 | 29.5 |
| 0.03 | 1 | yes | 7.5 | $NH_4OH$ | 20 | 29.0 |
| 0.03 | 1.5 | yes | 7.5 | $NH_4OH$ | 18 | 28.5 |
| 0.03 | 0.25 | yes | 10 | $NH_4OH$ | 45 | 29.5 |

The process spinning conditions and the polymer used are the same as those used in the tests in Table II.

The term "acrylic polymer" as used herein includes not only homopolymer of acrylonitrile, but also copolymers and mixtures thereof, and particularly those containing at least 80% by weight of polymerizable or copolymerizable acrylonitrile.

For instance, the polymer may be a copolymer containing from 80% to 98% of acrylonitrile and 2% to 20% of another copolymerizable mono-olefinic monomer. Suitable copolymerizable mono-olefinicmonomers include acrylic, alpha-chloro-acrylic and methacrylic acids; acrylates and methacrylates such as methylmethacrylate, ethyl-methacrylate, butyl-methacrylate, methoxymethylmethacrylate; beta-chlorethyl methacrylate and the corresponding esters of acrylic and alpha-chloroacrylic acids; vinyl chloride; vinyl fluoride; vinyl bromide; vinylidene chloride; 1-chloro-1-bromo-ethylene; methacrylonitrile; acrylamide and methacrylamide; alpha-chloro-acrylamide or their monoalkyl substituted derivatives; methyl-vinyl-ketone; vinyl esters such as vinyl acetate, vinyl chloroacetate; vinyl propionate and vinyl stearate; methylene malonic esters; itaconic acid and its esters; vinylfurane; alkyl-vinyl esters; vinylsulphonic acid; ethylene-alpha-beta-dicarboxylic acids or their anhydrides or derivatives such as diethyl citraconate, diethyl mesaconate; styrene, vinyl-naphthalene; sulphonic acids having an ethylenically unsaturated linkage and corresponding salts and other mono-olefinic monomers copolymerizable with acrylonitrile.

The polymer may also be a copolymer obtained by the copolymerization of acrylonitrile with two or more of any of the above-listed monomers other than acrylonitrile.

While the preferred polymers used in this invention are those containing at least 80% acrylonitrile, and in general are known as fiber-forming acrylic polymers, it is nevertheless to be understood that the invention may likewise be applied to polymers, copolymers and mixtures of polymers containing even less than 80% acrylonitrile and even as little as 35% acrylonitrile, provided they are soluble in dimethylacetamide.

The filaments obtained according to the process of this invention are subsequently subjected to washing in water, to stretching and then to heat treatment according to known spinning processes.

The following detailed working examples given in order even better to illustrate the invention idea of this invention and for the practical realization of the same. All parts and percentages are by weight unless otherwise indicated.

EXAMPLE 1

The polymer used in this example was a copolymer consisting of 93% of acrylonitrile and 7% of vinyl acetate, having a specific viscosity of 0.140 and 35 micro-equivalents/g of end acid groups. This copolymer was obtained by polymerization in an aqueous suspension in the presence of a catalytic system consisting of potassium persulphate and sulphur dioxide.

265 g of this copolymer were dissolved in 735 g of dimethylacetamide with a free acetic acid content of 0.3%, to which had previously been admixed 0.132 g of oxalic acid as a stabilizer and 1.3 g of titanium dioxide as a dulling agent.

The solution thus obtained was fed through a gear pump, at a flow rate of 15.7 cc/min., to a spinneret with 500 holes of 75$\mu$ diameter each. The filaments extruded through the spinneret were coagulated in a coagulating bath containing a mixture consisting of 45% dimethylacetamide (acetic acid content × 0.3%) and 55% of water, and maintained at a temperature of 45° C (acetic acid content of coagulating bath × 0.135%). The pH value of the coagulating bath was 4.2.

The filaments coming out of the coagulating bath were then gathered on rollers and stretched to a stretching ratio of 5.54 in order to obtain filaments with a titre of 2 den. Upon the examination under the microscope, at an enlargement of 15, of a sample drawn at the outlet of the coagulating bath and consisting of 20 filaments, there were statistically measured at about 200 voids/mm of single filament.

In order to determine the spinnability of the spinning solution, the maximum winding-up rate before breakage of the filaments at the outlet of the coagulating bath was measured. This speed proved to be 11 meters/minute.

By repeating the example but this time using a coagulating bath with a pH value of 7.5 obtained by the addition of ammonium hydroxide, the maximum winding-up speed remained the same but the voids present in the filaments leaving the coagulating bath statistically proved to be 80 per mm of single filament.

EXAMPLE 2

Example 1 was repeated but this time using a terpolymer consisting of 92.5% acrylonitrile, 7% vinylacetate and 0.5% sodium methallyl-sulphonate, having a specific viscosity of 0.15 and 48 micro-equivalents of acid end groups per gram of terpolymer.

The concentration of terpolymer in the dimethyacetamide spinning solution was 24.5%. The spinneret had 500 holes of 52$\mu$ diam. per hole. The flow rate of the gear pump for the spinning solution amounted to 16.98 cc/min. The coagulating bath consisted of 55% dimethylacetamide and 45% water. The pH value of the coagulating bath was 4 and the concentration of acetic acid therein was 0.165%. The filaments could be would up at a maximum winding-up rate of 14 meters/minute. The number of voids on the filaments at the outlet of the coagulating bath proved to be 140 per millimeter of single filament.

Upon repeating the run after adding to the coagulating bath NaOH until the pH value is brought up to 8, the maximum take-up speed remains the same while the number of voids is reduced to 25 per mm of single filament.

Using in the preparation of the spinning solution dimethylacetamide with a free acetic acid content of 0.03%, by bringing the coagulating bath up to 0.03% in acetic acid and the pH value to 8 by the addition of NaOH, the maximum take-up speed of the filaments leaving the coagulating bath was 17 meters/minute, and the number of voids on the filaments was statistically ascertained to be 15 per mm of single filament.

EXAMPLE 3

Example 2 was repeated but using a spinning solution having a concentration in terpolymer of 23%. The flow rate of the gear pump was 49.47 cc/min. and the filaments were stretched with a stretching ratio of 6.

At a pH = 4 of the coagulating bath, the maximum take-up speed of the filaments was 25.5 m/min. and the number of voids on the filaments was 380 per millimeter of single filament.

At a pH = 7 obtained by adding dimethylamine, the maximum take-up speed remained the same while the number of voids was 200 per mm of single filament.

What is claimed is:

1. In a process for the wet-spinning of acrylic polymers wherein a spinning solution of an acrylic polymer in an organic solvent consisting essentially of dimethylacetamide is extruded through a spinneret into a coagulating bath consisting essentially of water and dimethylacetamide in a ratio between 30:70 and 60:40 by weight, and wherein the filaments thus obtained are washed, stretched and heat treated, the improvement wherein the coagulating bath contains from 0.03% to 3% by weighht of acetic acid and has added thereto an alkaline compound so as to bring about a pH value greater than 5.

2. A process according to claim 1, wherein the pH value is between 6.5 and 8.

3. A process according to claim 1, wherein the solvent employed in the spinning solution is dimethylacetamide containing free acetic acid.

4. A process according to claim 3, wherein the dimethylacetamide has a free acid content of less than 0.1% by weight and wherein if necessary acetic acid is added to the coagulating bath to bring the concentration therein up to values between 0.03% and 3% by weight.

5. A process according to claim 1, wherein the pH value of greater than 5 is obtained by the addition to the coagulating bath of ammonium hydroxide.

6. A process according to claim 1, wherein the pH value greater than 5 is obtained by the addition to the coagulating bath of an alkali metal hydroxide.

7. A process according to claim 1, wherein the pH value greater than 5 is obtained by the addition to the coagulating bath of dimethylamine.

8. A process according to claim 1, wherein the acrylic polymer is one containing at least 80% of polymerized or copolymerized acrylonitrile.

9. Spun fibers, filaments or other similarly shaped articles when obtained according to the process defined in claim 1.

* * * * *